US011823856B2

(12) United States Patent
Wong

(10) Patent No.: US 11,823,856 B2
(45) Date of Patent: Nov. 21, 2023

(54) CONTACT LEVER ASSEMBLY FOR USE WITH AN ELECTRICAL SWITCH

(71) Applicants: DEFOND ELECTECH CO., LTD., Guangdong (CN); DEFOND COMPONENTS LIMITED, Chai Wan (HK)

(72) Inventor: Kin Yu Wong, Chai Wan (HK)

(73) Assignees: DEFOND COMPONENTS LIMITED, Chai Wan (HK); DEFOND ELECTECH CO., LTD., Hongmei (CN)

( * ) Notice: Subject to any disclaimer, the term of this patent is extended or adjusted under 35 U.S.C. 154(b) by 0 days.

(21) Appl. No.: 17/119,656

(22) Filed: Dec. 11, 2020

(65) Prior Publication Data

US 2021/0183604 A1 Jun. 17, 2021

(30) Foreign Application Priority Data

Dec. 12, 2019 (HK) ..... 19133517.3

(51) Int. Cl.
*H01H 71/52* (2006.01)
*H01H 71/02* (2006.01)

(52) U.S. Cl.
CPC ..... *H01H 71/521* (2013.01); *H01H 71/02* (2013.01); *H01H 71/523* (2013.01)

(58) Field of Classification Search
CPC .... H01H 71/521; H01H 71/02; H01H 71/523; H01H 2001/00; H01H 2001/22; H01H 2001/221; H01H 2001/24; H01H 2001/223; H01H 2001/50; H01H 71/00; H01H 71/10; H01H 71/52; H01H 71/522; H01H 71/526; H01H 3/32; H01H 3/38; H01H 3/60; H01H 69/00; H01H 73/00; H01H 73/06; H01H 85/00; H01H 85/165; H01H 85/175;
(Continued)

(56) References Cited

U.S. PATENT DOCUMENTS 4,673,778 A 6/1987 Lewandowski et al.

FOREIGN PATENT DOCUMENTS

CN 108257799 A 9/2018
CN 109659172 A 4/2019
(Continued)

OTHER PUBLICATIONS

Patentability Search Report from related Hong-Kong Patent Application No. 19133517.3, dated Dec. 31, 2019, 6 pages.
(Continued)

*Primary Examiner* — Anthony R Jimenez
(74) *Attorney, Agent, or Firm* — NORTON ROSE FULBRIGHT US LLP

(57) ABSTRACT

An electrical switch including a switch housing, a switch circuit disposed within the switch housing. The switch circuit including includes a movable contact member mounted on a contact lever and a stationary contact member. The contact lever is configured for operable-interaction with an actuator. The actuator is configured for movement along an actuator movement axis relative to the contact lever between at least one of an OFF position whereby the contact lever is configured for arrangement in to the first configuration whereby the switch circuit is opened, and, an ON position in which the contact lever is configured for arrangement in to the second configuration whereby the switch circuit is closed.

24 Claims, 2 Drawing Sheets

(58) Field of Classification Search
CPC ..... H01H 2009/02; H01H 2221/062; H01H 2235/00; H01H 2235/01
USPC ..... 200/293
See application file for complete search history.

(56) References Cited

FOREIGN PATENT DOCUMENTS

| | | | |
|---|---|---|---|
| CN | 110518900 | A | 11/2019 |
| JP | 2018-41690 | A | 3/2018 |

OTHER PUBLICATIONS

Office Action dated Jul. 27, 2021, that issued in realted DE Application No. 102020132047.7.

CONTACT LEVER ASSEMBLY FOR USE WITH AN ELECTRICAL SWITCH

CROSS-REFERENCE TO RELATED APPLICATION

The present application claims priority to Hong Kong Short-Term Patent Application Serial No. 19133517.3, filed on Dec. 12, 2019, and entitled "A CONTACT LEVER ASSEMBLY FOR USE WITH AN ELECTRICAL SWITCH," the benefit of which is claimed and the disclosure of which is herein incorporated by reference in its entirety.

TECHNICAL FIELD

The present invention relates to contact lever assemblies for use with electrical switches for instance as used in electric power tools and the like.

BACKGROUND OF THE INVENTION

In certain electrical switch assemblies, for instance as used in electric power tools, a contact lever having a movable contact is selectably moved in and out of contact with a stationary contact member in response to operation of a trigger actuator of the power tool so as to turn the switch ON and OFF respectively. Conventionally, the contact lever is generally biased into an OFF position by a return spring which has a first end secured directly to the surface of the contact lever, and, a second end rigidly secured at a spaced-apart anchor point in the switch housing. With such existing assemblies, the return spring and the contact lever tend to cause wear against each other due to repeated movement of the contact lever and return spring against each other. Furthermore, the contact lever tends to experience undesirable vibratory movement as a result of the elasticity of the return spring whenever the contact lever is moved between ON and OFF positions and this can result in conducing of the movable contact member against the stationary contact member, and consequently, poor electrical connectivity of the electrical switch. In certain cases, this may give rise to arcing and sparking between the contact members which may cause the contact members to fuse together.

SUMMARY OF THE INVENTION

The present invention seeks to alleviate at least one of the above-described problems.

The present invention may involve several broad forms. Embodiments of the present invention may include one or any combination of the different broad forms herein described.

In one broad form, the present invention provides an electrical switch including:

a switch housing;

a switch circuit disposed within the switch housing, said switch circuit including a movable contact member mounted on a contact lever and a stationary contact member, wherein said contact lever is movable between at least one of a first configuration in which the movable contact member is not in contact with the stationary contact member so as to open the switch circuit, and, a second configuration in which the movable contact member is in contact with the stationary contact member so as to close the switch circuit;

said contact lever being configured for operable-interaction with an actuator, said actuator being configured for movement along an actuator movement axis relative to the contact lever between at least one of an OFF position whereby the contact lever is configured for arrangement in to the first configuration whereby the switch circuit is opened, and, an ON position in which the contact lever is configured for arrangement in to the second configuration whereby the switch circuit is closed;

a biasing element configured for biasing the contact lever towards the second configuration so that the switch circuit is closed when the actuator is moved relative to the contact lever in to the ON positions, said biasing element including a first end attached to a first attachment point in connection with a portion of the contact lever and a second end attached to a second attachment point in connection with the switch housing; and an attachment member configured for attachment with the contact lever whereby when attached to the contact lever, said attachment member is configured for operation as the first attachment point in connection with the portion of the contact lever.

In another broad form, the present invention provides an attachment member for a contact lever of an electrical switch, the electric switch including:

a switch housing;

a switch circuit disposed within the switch housing, said switch circuit including a movable contact member mounted on a contact lever and a stationary contact member, wherein said contact lever is movable between at least one of a first configuration in which the movable contact member is not in contact with the stationary contact member so as to open the switch circuit, and, a second configuration in which the movable contact member is in contact with the stationary contact member so as to close the switch circuit;

said contact lever being configured for operable-interaction with an actuator, said actuator being configured for movement along an actuator movement axis relative to the contact lever between at least one of an OFF position whereby the contact lever is configured for arrangement in to the first configuration whereby the switch circuit is opened, and, an ON position in which the contact lever is configured for arrangement in to the second configuration whereby the switch circuit is closed; and a biasing element configured for biasing the contact lever towards the second configuration so that the switch circuit is closed when the actuator is moved relative to the contact lever in to the ON positions, said biasing element including a first end attached to a first attachment point in connection with a portion of the contact lever and a second end attached to a second attachment point in connection with the switch housing;

wherein, the attachment member is configured for attachment with the contact lever whereby when attached to the contact lever, said attachment member is configured for operation as the first attachment point in connection with the portion of the contact lever.

In yet another broad form, the present invention provides a contact lever assembly for use with an electrical switch, the electric switch including:

a switch housing;

a switch circuit disposed within the switch housing, said switch circuit including a stationary contact member mounted within the switch housing and a movable contact member mounted on a contact lever of the contact lever assembly, wherein said contact lever is movable between at least one of a first configuration in which the movable contact member is not in contact with the stationary contact member so as to open the switch circuit, and, a second configuration in which the movable contact member is in contact with the stationary contact member so as to close the switch circuit;

said contact lever being configured for operable-interaction with an actuator, said actuator being configured for movement along an actuator movement axis relative to the contact lever between at least one of an OFF position whereby the contact lever is configured for arrangement in to the first configuration whereby the switch circuit is opened, and, an ON position in which the contact lever is configured for arrangement in to the second configuration whereby the switch circuit is closed; and a biasing element configured for biasing the contact lever towards the second configuration so that the switch circuit is closed when the actuator is moved relative to the contact lever in to the ON positions, said biasing element including a first end attached to a first attachment point in connection with a portion of the contact lever and a second end attached to a second attachment point in connection with the switch housing;

wherein, said contact lever assembly includes an attachment member configured for attachment with the contact lever whereby when attached to the contact lever, said attachment member is configured for operation as the first attachment point in connection with the portion of the contact lever.

Preferably, the biasing member may include a coil spring.

Preferably, the attachment member may be configured to alleviate vibratory movement of the contact lever when it moves the movable contact member in to contact with the stationary contact member.

Preferably, the attachment member may be configured to alleviate lateral movement of the biasing member.

Preferably, the attachment member may be configured to provide an intermediate protective layer between the biasing member and the contact lever so as to protect at least one of the biasing member and the contact lever from wear.

Preferably, the attachment member may include at least one of a plastic material, a rubber material, and a polymeric material.

The attachment member may include a hole, whereby said attachment member is configured for attachment with the contact lever by sliding a first end of the contact lever through the hole in the attachment member when the movable contact member is not mounted on the contact lever.

Alternately, the attachment member may include at least a first portion and a second portion that are configured for assembly together about the contact lever to effect attachment of the attachment member with the contact lever. Also preferably, the first and second portions may be configured for at least one of snap-fitting assembly, friction-fitting assembly and adhesive assembly together around the contact lever to effect attachment. Yet alternately, the attachment member may be attached to the contact lever by using over-molding techniques so that the attachment member is over-molded to the contact lever.

Alternately, the attachment member may be configured for adhesive attachment to the contact lever.

Alternately, attachment member may include a shaped-portion configured for at least one of snap-fitting and friction-fitting engagement around the contact lever.

Preferably, the second attachment point in connection with the switch housing may include at least one of a plastic material, a rubber material, and a polymeric material.

It will be apparent that the present invention may assist in providing at least one advantage over conventional technologies contact lever technologies including for instance that it may assist in alleviating vibratory motion of the contact lever when it is moves the movable contact member in to contact with the stationary contact member. In particular, the attachment member may assist in alleviating high vibrational bouncing of the movable contact member on the stationary contact member which may result in electrical sparking, arcing between the respective contact members during operation which may dangerously result in welding/fusing of the contact members together. Yet further, the attachment member may be configured for indirect attachment connection with portion of the contact lever so as to assist in alleviating lateral movement of the biasing member (e.g. a coil spring) when the first end of the biasing member is attached thereon. By alleviating lateral movement of the biasing member, this assists in providing a firmer and cleaner point of contact between the movable contact member and the stationary contact member during operation of the switch. Yet further, the attachment member may be configured to provide an intermediate protective layer or cushion between the biasing member and the contact lever so as to protect at least one of the biasing member and the contact lever from undue wear that may tend to occur in conventional technologies when there is direct attachment contact between the biasing member and the contact lever surface. In the context of conventional electric power tools where relatively high currents may pass through the electrical switch circuit during use, and where the contact lever is directly connected to the coil spring, the heat generated by the high currents may also damage the biasing member and thereby compromise the ability of the biasing member (and hence the electric switch circuit) to function properly. Yet further, the attachment member may be relative easily, efficiently and cost-effectively produced using for instance any suitable molding technique if forming the attachment member from hard or soft plastic. Yet further, the attachment member of the present invention is configured for ease of assembly with existing contact lever parts, for instance, by simply sliding the attachment member over the contact lever or snap-fitting or clipping separate parts of the attachment member together about the contact lever to effect attachment, and, may be retrofitted to existing contact levers with minimum complexity involved. Yet further, in certain embodiments of the present invention, the attachment member may be attached to the contact lever by using over-molding techniques so that the attachment member is over-molded to the contact lever.

BRIEF DESCRIPTION OF THE DRAWINGS

The present invention will become more fully understood from the following detailed description of a preferred but non-limiting embodiments thereof, described in connection with the accompanying drawings, wherein.

DETAILED DESCRIPTION OF THE PREFERRED EMBODIMENTS

Figure 1:
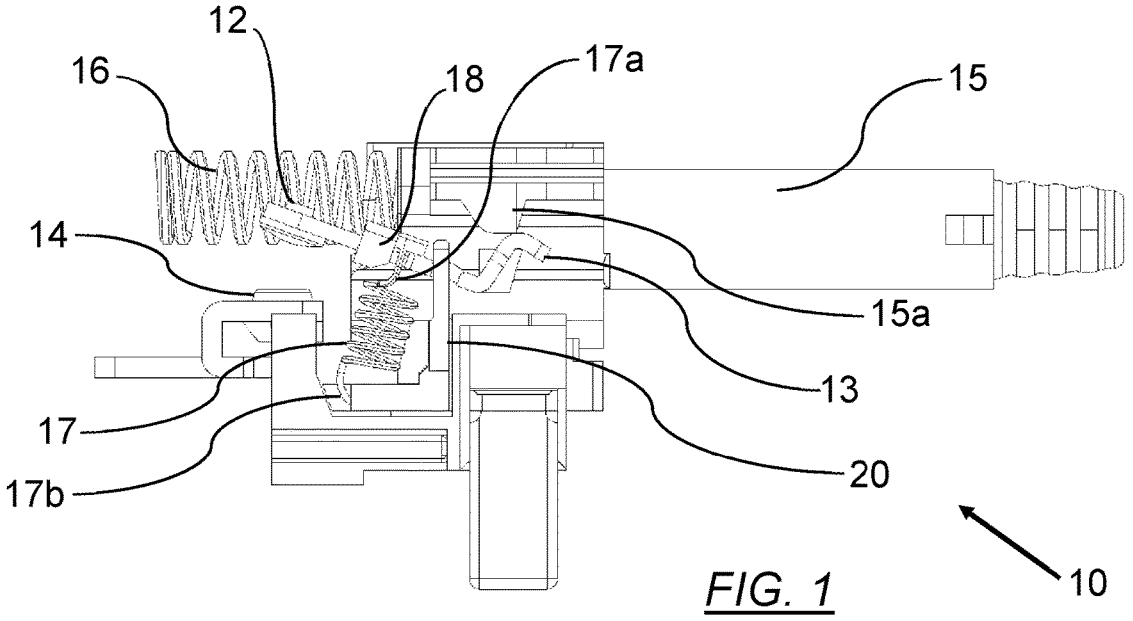
FIG. 1 shows a side-view of an electrical switch arranged in an OFF position in accordance with an embodiment of the present invention.
Figure 2:
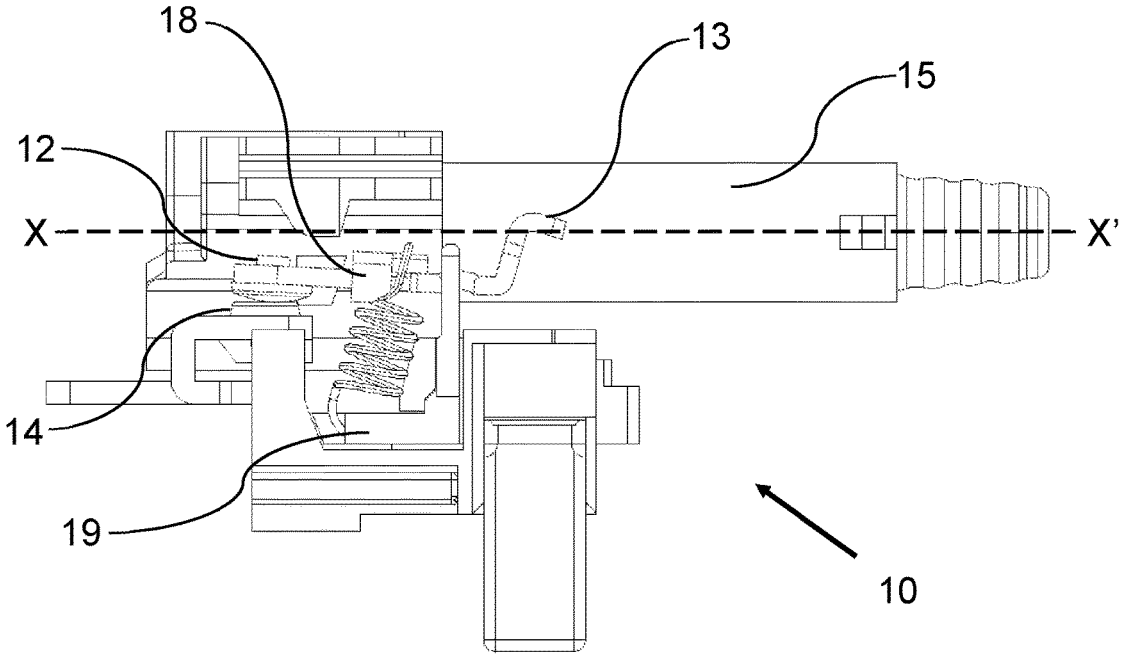
FIG. 2 shows a side-view of the electrical switch arranged in an ON position in accordance with an embodiment of the present invention.
Figure 3:
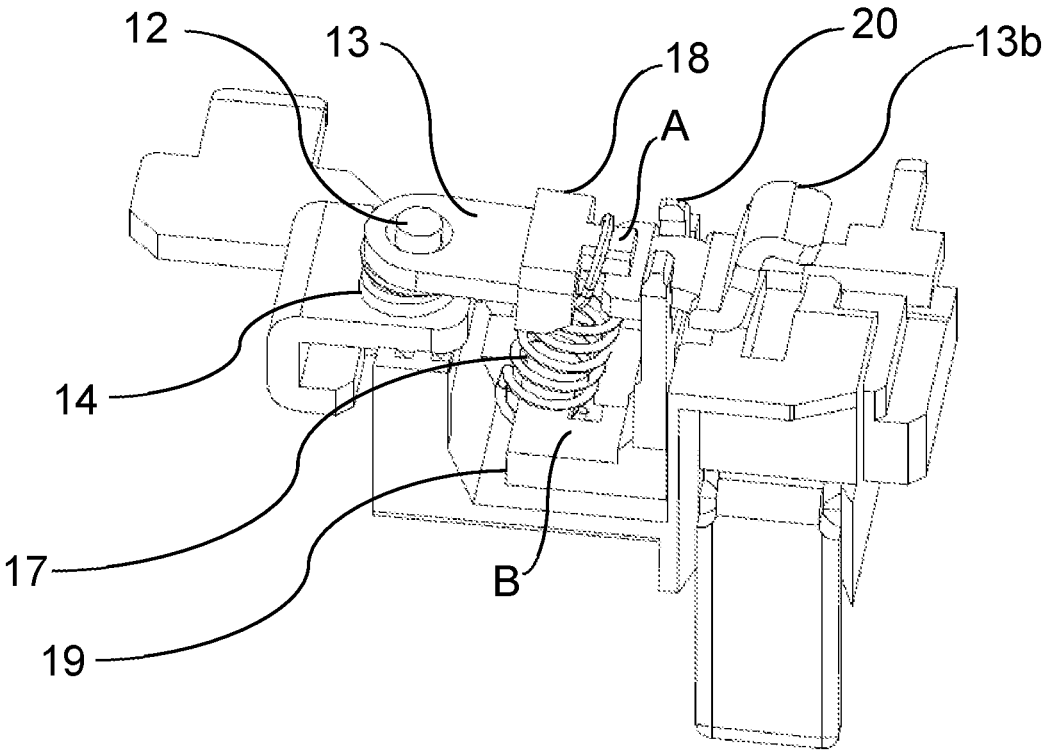
FIG. 3 shows a perspective-view of the electrical switch arranged in the ON position in accordance with an embodiment of the present invention.
Figure 4:
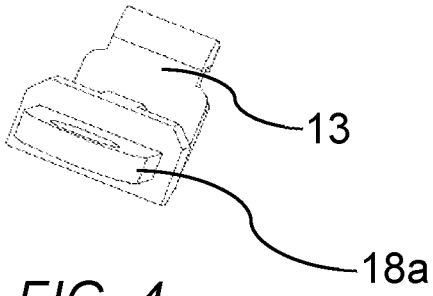
FIG. 4 shows a front-view of a contact lever used in accordance with an embodiment of the present invention wherein an attachment member is fitted on the contact lever.

Preferred embodiments of the present invention will now be described herein with reference to FIGS. 1 to 6. The embodiments comprise a contact lever assembly (11) (as shown in stand-alone fashion in FIGS. 4-6) for use with an electrical switch (10) of an electric power tool (as shown in FIGS. 1-3). The electric power tool includes for instance an electric drill, screwdriver, grinder, sander, saw, rotary driving tool and the like having a battery and an electrical motor arranged in series with the electrical switch (10). The electrical switch (10) may typically be actuated by a push-button or trigger assembly type actuator arrangement by way of example. It would be appreciated and understood that whilst this embodiment is described for use with an electric power tool, this is merely for purposes of illustrating functionality of the inventive concept and alternate embodiments of the present invention may of course be used with other types of electrical devices such as gardening tools and home appliances. Furthermore, whilst embodiments of the present invention described herein refer to electric devices comprising an electric motor, it would be appreciated that alternate embodiments of the present invention may also be applicable to electric devices which comprise a solenoid type electro-mechanical unit to effect operable movement (e.g. reciprocal motion) of the electric device.

The electrical switch (10) includes a moulded plastic or metal switch housing (not shown) that is mounted to a body of the electric power tool near to a handle of the electric power tool. The switch housing includes a first switch housing member and a second switch housing member that may be either snap-fitted or screwed together to securely enclose components of the switch circuit module therein.

A switch circuit is disposed within the switch housing which includes a movable contact member (12) (i.e. a movable contact rivet) mounted on a first end (13*a*) of the contact lever (13) which is in turn electrically connected with a first switch circuit terminal (not shown). The switch circuit also includes a stationary contact member (14) (i.e. a stationary contact rivet) that is rigidly mounted on a second electrically-conductive switch circuit terminal of the switch circuit. The contact lever (13) is pivotable about a fulcrum (20) between at least one of a first configuration in which the movable contact member (12) is not in contact with the stationary contact member (14) as shown in FIG. 1 so as to open the switch circuit, and, a second configuration in which the movable contact member (12) is in contact with the stationary contact member (14) as shown in FIG. 2 so as to close the switch circuit. When the switch circuit is closed, power is able to be transferred from the battery to the electric motor via the electrical switch (10). When the electrical switch (10) is opened, power is no longer able to be transferred from the battery to the electric motor via the electric switch (10).

The electrical switch (10) includes an actuator (15) having a finger-operable portion (not shown) that is configured for operable-interaction with the contact lever (13). The actuator (15) is configured for movement along an actuator movement axis (X-X') relative to the switch housing between at least one of an OFF position (as shown in FIG. 1) and an ON position (as shown in FIG. 2). The actuator (15) is biased into the OFF position by an actuator return spring (16). When no force is applied to the actuator (15) it is arranged in the OFF position whereby it is maximally extended outwardly of the switch housing. In the OFF position a shaped portion (15*a*) of the actuator (15) interacts with a second end (13*b*) of contact lever (13) so that the contact lever (13) is pivoted about the fulcrum (20) in to the first configuration and whereby the switch circuit is arranged in the opened state. When the actuator (15) is arranged in to the ON position, it is slidably moved inwardly of the switch housing along the actuator movement axis whereby the shaped portion (15*a*) of the actuator (15) no longer abuts against the second end (13*b*) of the contact lever (13) and the contact lever (13) is thereby able to be again pivot about the fulcrum (20) by urging of a contact lever return spring (17) into the closed state. In these embodiments, and in contrast to conventional type contact lever assemblies, a first end (17*a*) of the contact lever return spring (17) is not attached directly to the contact lever (13). Instead, the first end (17*a*) of the contact lever return spring (17) is indirectly attached to the contact lever (13) via an intermediate attachment member (18). In these embodiments, the attachment member (18) may be formed from at least one of a plastic material, a rubber material, a polymeric material any other material suitable within the functional context of the embodiments of the present invention.

Figure 5:
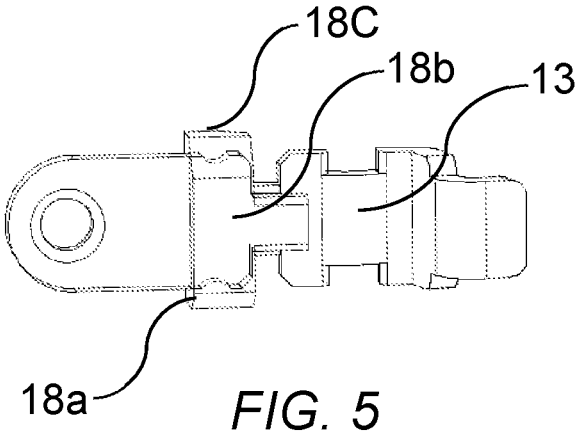
FIG. 5 shows a top-view of the contact lever used in accordance with an embodiment of the present invention wherein an attachment member is fitted on the contact lever.
Figure 6:
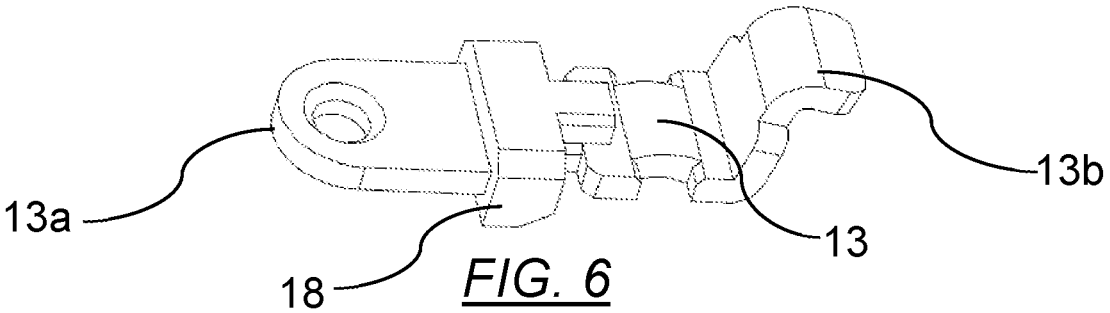
FIG. 6 shows a perspective-view of the contact lever used in accordance with an embodiment of the present invention wherein an attachment member is fitted on the contact lever.

The attachment member (18) may be configured for secure and rigid attachment with the contact lever (13) in any number of possible ways including for instance by forming the attachment member (18) with a hole (18*a*) that may allow the attachment member (18) to be slid over the first end (13*a*) of the contact lever (13) before the movable contact member (12) has been mounted on the first end (13*a*) of the contact lever (13). The attachment member (18) would typically be formed such that the hole (18*a*) complements and fits snugly around the cross-sectional shape contour of the contact lever (13) and so that the attachment member (18) may be slid roughly midway along the contact lever (13). In such an embodiment, the attachment member (18) may be for instance integrally molded as a single piece of plastic. Alternately, the attachment member (18) may be formed from at least a first portion (18*b*) and a separately formed second portion (18*c*) that are configured for assembly together about the contact lever (13) to effect attachment of the attachment member (18) with the contact lever (13) such as is shown in FIG. 5. The first and second portions (18*b*, 18*c*) may be securely assembled together around the contact lever (13) without requiring any additional means of securement—for instance by way of snap-fitting engagement, friction-fitting engagement or adhesive engagement. In such an embodiment, when assembled together around the contact lever (13), the attachment member (18) may, as in the above case, also form a snug and secure fit so that it may be rigidly secured to the contact lever (13) and not move about during operation of the electrical switch (10). Alternately, in certain embodiments, the attachment member (18) may comprise a single-piece of material that is not fitted around the contact lever (13) may instead by adhesively attached to the contact lever (13). Alternately, the attachment member (18) may include a shaped-portion configured that is configured for snap-fitting or friction-fitting engagement around the contact lever (18). For instance, the attachment member (18) could include a c-shaped cross-section which complements the cross-sectional shape contour of the contact lever (13) whereby the attachment member (18) may be configured for snap-fitting engagement or friction-fitting engagement about the contact lever (13) by pressing the body of the contact lever (13) through the gap in the C-shaped configuration of the attachment member (18). Once the attachment member (18) has been securely attached to the contact lever (13), a first end (17*a*) of the contact lever return spring (17) is able to be secured to the attachment member (18) (and hence indirectly secured to the contact lever (13)), for instance by threading or looping the first end (17*a*) of the contact lever return spring (17) through or around a shaped-portion of the attachment member (18). The tip of the first end (17*a*) of the contact lever return spring (17) may also be bent in a manner which restricts the first end (17*a*) from being detached from the shaped portion of the attachment member (18). In certain embodiments, a second end (17*b*) of the contact lever return spring (17) may be configured for attachment to a second attachment member (19) which may be mounted in the switch housing spaced-apart from the first attachment member as shown in the drawings in a similar fashion to as described above. The additional securement of the second end (17*b*) of the contact lever return spring (17) to the second attachment member (19) may further assist in alleviating the above-described problems.

Any suitable material may be used in these embodiments whereby the material used may be configured to alleviate vibratory movement of the contact lever (13) when it moves the movable contact member (12) in to contact with the stationary contact member (14), may be configured to alleviate lateral movement of the contact lever return spring (17), and, may be configured to provide an intermediate protective layer or cushion between the contact lever return spring (17) and the contact lever (13) so as to protect at least one of the contact lever return spring (17) and the contact lever (13) from undue wear. The choice of material in these embodiments will be a soft or a hard plastic material. However, a rubber material, and, a polymeric material may also be used amongst other things.

Those skilled in the art will appreciate that the invention described herein is susceptible to variations and modifications other than those specifically described without departing from the scope of the invention. All such variations and modification which become apparent to persons skilled in the art, should be considered to fall within the spirit and scope of the invention as broadly hereinbefore described. It is to be understood that the invention includes all such variations and modifications. The invention also includes all of the steps and features, referred or indicated in the specification, individually or collectively, and any and all combinations of any two or more of said steps or features.

The reference to any prior art in this specification is not, and should not be taken as, an acknowledgment or any form of suggestion that that prior art forms part of the common general knowledge.

What is claimed is:

1. An attachment member for a contact lever of an electrical switch, the electrical switch including:

a switch housing;

a switch circuit disposed within the switch housing, said switch circuit including a movable contact member mounted on a contact lever and a stationary contact member, wherein said contact lever is movable between at least one of a first configuration in which the movable contact member is not in contact with the stationary contact member so as to open the switch circuit, and, a second configuration in which the movable contact member is in contact with the stationary contact member so as to close the switch circuit;

said contact lever being configured for operable-interaction with an actuator, said actuator being configured for movement along an actuator movement axis relative to the contact lever between at least one of an OFF position whereby the contact lever is configured for arrangement into the first configuration whereby the switch circuit is opened, and, an ON position in which the contact lever is configured for arrangement into the second configuration whereby the switch circuit is closed; and a biasing element configured for biasing the contact lever towards the second configuration so that the switch circuit is closed when the actuator is moved relative to the contact lever into the ON position, said biasing element including a first end attached to a first attachment point (A) in connection with a portion of the contact lever and a second end attached to a second attachment point (B) in connection with the switch housing;

wherein, the attachment member comprises a first attachment member and a second attachment member, said first attachment member being configured for attachment with the contact lever and whereby said first attachment member is configured to provide the first attachment point for attachment with the first end of the biasing element, and said second attachment member being configured for mounting to the switch housing and spaced apart from the first attachment member, and whereby said second attachment member is configured to provide the second attachment point for attachment with the second end of the biasing element; and whereby said first and second attachment members include at least one of a plastic material, a rubber material, and a polymeric material, and are configured to alleviate vibratory movement of the contact lever when it moves the movable contact member into contact with the stationary contact member.

2. An attachment member as claimed in claim 1 wherein the biasing element includes a coil spring.

3. An electrical switch as claimed in claim 1 wherein said attachment member is configured to alleviate vibratory movement of the contact lever when it moves the movable contact member into contact with the stationary contact member.

4. An attachment member as claimed in claim 1 wherein said attachment member is configured to alleviate lateral movement of the biasing element.

5. An attachment member as claimed in claim 1 wherein said attachment member is configured to provide an intermediate protective layer between the biasing element and the contact lever so as to protect at least one of the biasing element and the contact lever from wear.

6. An attachment member as claimed in claim 1 wherein the attachment member includes a hole, whereby said attachment member is configured for attachment with the contact lever by sliding a first end of the contact lever through the hole in the attachment member when the movable contact member is not mounted on the contact lever.

7. An attachment member as claimed in claim 1 wherein said attachment member is configured for adhesive attachment to the contact lever.

8. An attachment member as claimed in claim 1 wherein said attachment member includes a shaped-portion configured for at least one of snap-fitting and friction-fitting engagement around the contact lever.

9. An electrical switch as claimed in claim 1 wherein the attachment member is over-molded with the contact lever to effect attachment of the attachment member with the contact lever.

10. An attachment member as claimed in claim 1 wherein the second attachment point in connection with the switch housing includes at least one of a plastic material, a rubber material, and a polymeric material.

11. An attachment member as claimed in claim 1 wherein the attachment member includes at least a first portion and a second portion that are configured for assembly together about the contact lever to effect attachment of the attachment member with the contact lever.

12. An attachment member as claimed in claim 11 where the first and second portions are configured for at least one of snap-fitting assembly, friction-fitting assembly and adhesive assembly together around the contact lever to effect attachment.

13. A contact lever assembly for use with an electrical switch, the electrical switch including:

a switch housing;

a switch circuit disposed within the switch housing, said switch circuit including a stationary contact member mounted within the switch housing and a movable contact member mounted on a contact lever of the contact lever assembly, wherein said contact lever is movable between at least one of a first configuration in which the movable contact member is not in contact with the stationary contact member so as to open the switch circuit, and, a second configuration in which the movable contact member is in contact with the stationary contact member so as to close the switch circuit;

said contact lever being configured for operable-interaction with an actuator, said actuator being configured for movement along an actuator movement axis relative to the contact lever between at least one of an OFF position whereby the contact lever is configured for arrangement into the first configuration whereby the switch circuit is opened, and, an ON position in which the contact lever is configured for arrangement into the second configuration whereby the switch circuit is closed; and a biasing element configured for biasing the contact lever towards the second configuration so that the switch circuit is closed when the actuator is moved relative to the contact lever in to into the ON position, said biasing element including a first end attached to a first attachment point (A) in connection with a portion of the contact lever and a second end attached to a second attachment point (B) in connection with the switch housing;

wherein, said contact lever assembly includes an attachment member configured for attachment with the contact lever, whereby when attached to the contact lever, said attachment member is configured for operation as the first attachment point in connection with the portion of the contact lever, and whereby said attachment member is configured to alleviate vibratory movement of the contact lever when it moves the movable contact member into contact with the stationary contact member; and wherein, said attachment member comprises a first attachment member and a second attachment member, said first attachment member being configured for attachment with the contact lever so as to provide the first attachment point for the first end of the biasing element, and said second attachment member being configured for mounting to the switch housing and spaced apart from the first attachment member such that the second attachment member is configured for providing the second attachment point for attachment with the second end of the biasing element; and whereby said first and second attachment members include at least one of a plastic material, a rubber material, and a polymeric material, and are configured to alleviate vibratory movement of the contact lever when it moves the movable contact member into contact with the stationary contact member.

14. A contact lever assembly as claimed in claim 13 wherein the biasing element includes a coil spring.

15. An electrical switch as claimed in claim 13 wherein said attachment member is configured to alleviate vibratory movement of the contact lever when it moves the movable contact member into contact with the stationary contact member.

16. A contact lever assembly as claimed in claim 13 wherein said attachment member is configured to alleviate lateral movement of the biasing element.

17. A contact lever assembly as claimed in claim 13 wherein said attachment member is configured to provide an intermediate protective layer between the biasing element and the contact lever so as to protect at least one of the biasing element and the contact lever from wear.

18. A contact lever assembly as claimed in claim 13 wherein the attachment member includes a hole, whereby said attachment member is configured for attachment with the contact lever by sliding a first end of the contact lever through the hole in the attachment member when the movable contact member is not mounted on the contact lever.

19. A contact lever assembly as claimed in claim 13 wherein the attachment member is configured for adhesive attachment to the contact lever.

20. A contact lever assembly as claimed in claim 13 wherein said attachment member includes a shaped-portion configured for at least one of snap-fitting and friction-fitting engagement around the contact lever.

21. An electrical switch as claimed in claim 13 wherein attachment member is over-molded with the contact lever to effect attachment of the attachment member with the contact lever.

22. A contact lever assembly as claimed in claim 13 wherein the second attachment point in connection with the switch housing includes at least one of a plastic material, a rubber material, and a polymeric material.

23. A contact lever assembly as claimed in claim 13 wherein the attachment member includes at least a first portion and a second portion that are configured for assembly together about the contact lever to effect attachment of the attachment member with the contact lever.

24. A contact lever assembly as claimed in claim 23 wherein the first and second portions are configured for at least one of snap-fitting assembly, friction-fitting assembly and adhesive assembly together around the contact lever to effect attachment.

* * * * *